US007241214B2

(12) United States Patent
Sixsmith

(10) Patent No.: US 7,241,214 B2
(45) Date of Patent: Jul. 10, 2007

(54) UPBLAST FAN NOZZLE WITH WIND DEFLECTING PANELS

(75) Inventor: Richard Sixsmith, Washago (CA)

(73) Assignee: Plasticair, Inc., Mississauga, Ontario (CA)

( * ) Notice: Subject to any disclaimer, the term of this patent is extended or adjusted under 35 U.S.C. 154(b) by 0 days.

(21) Appl. No.: 11/042,680

(22) Filed: Jan. 25, 2005

(65) Prior Publication Data

US 2005/0166809 A1 Aug. 4, 2005

(30) Foreign Application Priority Data

Jan. 26, 2004 (CA) ..... 2456249

(51) Int. Cl.
*F23L 17/02* (2006.01)

(52) U.S. Cl. ..... 454/17; 454/3

(58) Field of Classification Search ..... 454/341, 454/35–39, 118; 110/160
See application file for complete search history.

(56) References Cited

U.S. PATENT DOCUMENTS

| | | | | |
|---|---|---|---|---|
| 352,597 A | | 11/1886 | Wohlfert | |
| 1,726,152 A | * | 8/1929 | Kiesel, Jr. | 417/155 |
| 2,188,564 A | | 1/1940 | Berg | |
| 2,265,112 A | | 12/1941 | Davies | |
| 2,551,292 A | * | 5/1951 | Robbins | 454/39 |
| 3,385,197 A | | 5/1968 | Greber | |
| 3,719,032 A | | 3/1973 | Cash | |
| 3,797,373 A | | 3/1974 | Larson | |
| 4,806,076 A | | 2/1989 | Andrews | |
| 5,439,349 A | | 8/1995 | Kupferberg | |
| 6,112,850 A | * | 9/2000 | Secrest et al. | 181/224 |
| 6,676,503 B2 | | 1/2004 | Hill et al. | |

OTHER PUBLICATIONS

Vektor High Plume Dilution Laboratory Exhaust System, brochure of Greenheck Fan Corp. dated Jan. 2004.

* cited by examiner

*Primary Examiner*—Kenneth Rinehart
*Assistant Examiner*—Helena Kosanovic
(74) *Attorney, Agent, or Firm*—Gifford, Krass, Sprinkle, Anderson & Citkowski, P.C.

(57) ABSTRACT

An exhaust gas discharging apparatus for connection to an exhaust gas fan including an exhaust gas nozzle comprising a duct device forming at least one exhaust passage that extends between first and second open ends. The duct device has at least one exterior duct wall forming at least two longitudinally extending bent wall portions that are distributed evenly about the periphery of the duct device with each bent wall portion sloping towards the longitudinal axis in the region of the second end. An annular cap or wind band is connected to the duct device and is disposed about and spaced apart from the second end of the duct device. The cap has a cap inlet located below the second end and outside the duct device and a cap outlet located outwardly from the second end in the longitudinal direction. Vertically extending wind deflecting panels are mounted on the duct device and extend horizontally outwardly and these panels extend vertically below the cap. The panels can be flat or curved as seen in horizontal cross-section.

12 Claims, 12 Drawing Sheets

UPBLAST FAN NOZZLE WITH WIND DEFLECTING PANELS

BACKGROUND OF THE INVENTION

This invention relates to exhaust ducts and exhaust stacks and, in particular, such stacks adapted for attachment to the outlet of an exhaust fan which can be either a centrifugal fan or an axial fan.

Conventional discharge stacks of considerable height are well known in industry, these stacks being used to discharge various exhaust gases to atmosphere. Often these conventional stacks must be of substantial height in order that the gases can be discharged effectively without causing undesirable environmental consequences to the surrounding area and persons working or living in the area of the discharge stack. Because of the necessary height of these conventional stacks, they can be quite expensive to build and erect.

It will also be appreciated that many exhaust gases are noxious and therefore it is desirable when constructing an exhaust system for a building or industrial operation to attempt to ensure that these exhaust gases do not persist at low altitudes but instead travel upwardly into the atmosphere. Although the aforementioned tall exhaust stacks can be effective for their intended purpose, not only are they costly but they can also be unsightly and they may exceed height restrictions imposed by zoning by-laws.

In order to approximate the performance of these tall stacks, so called upblast fans with relatively short stacks have been developed. However, it has been found that where an upblast fan uses a short stack of conventional construction, the exhaust fan system can be deficient in its ability to properly exhaust gases upwardly into the atmosphere.

A class of upblast fan that has proven to be relatively effective in the propulsion of exhaust gas upwardly into the atmosphere are recently developed upblast fans employing either radial fans or centrifugal fans having an upwardly directed outlet that is connected to a special exhaust gas nozzle. Representative of this class is U.S. Pat. No. 4,806,076 issued Feb. 21, 1989 to Strobic Air Corporation. This known upblast exhaust fan apparatus includes a split, upwardly extending nozzle with a passive zone section located centrally between first and second inner walls. The inner walls cooperate with first and second outer walls to provide first and second exhaust flow paths that lead to two exhaust outlets at the top end. A wind band is secured to the upper end of the exhaust nozzle housing adjacent the exhaust openings and in spaced relation to the outer walls of this housing. In this way, ambient air can be effectively mixed with the exhaust gases. Another recent U.S. patent which teaches an exhaust fan apparatus of this general type is U.S. Pat. No. 5,439,349 to Kupferberg issued Aug. 8, 1995.

In U.S. Pat. No. 6,676,503 issued Jan. 13, 2004 and entitled EXHAUST GAS NOZZLE FOR FAN, there are described several different embodiments of an exhaust gas nozzle that includes a duct member forming a single exhaust passage that extends between first and second open ends. The duct member is formed by a duct wall having at least two longitudinally extending bent wall portions that are distributed evenly about the periphery of the duct member which extends about its longitudinal axis. Each bent wall portion projects inwardly towards the longitudinal axis as seen in transverse planes in the region of the second end. An annular cap is connected to the duct member of this nozzle and is disposed about the exterior of and in spaced relation to the second end of the duct member.

It is an object of one aspect of the present invention to provide an improved form of exhaust gas discharging apparatus which employs vertically extending wind deflecting members or vanes mounted on the duct device and extending horizontally outwardly from the duct wall. These members or vanes extend vertically below an annular cap provided on the discharging apparatus.

SUMMARY OF THE INVENTION

According to one aspect of the invention, an exhaust gas discharging apparatus comprises an exhaust gas nozzle including a duct device forming at least one exhaust passage that extends from an open first end to an open second end of the duct device. The duct device has a centrally disposed longitudinal axis extending between the first and second ends and is provided by at least one exterior duct wall forming at least two longitudinally extending bent wall portions that are distributed evenly about the periphery of the duct device. Each bent wall portion slopes inwardly towards the longitudinal axis in the region of the second end. The gas nozzle also includes an annular cap connected to the duct device and disposed about the exterior of and in spaced, substantially co-axial relation to the second end of the duct device. This cap has a cap inlet located between the first end and the second end of the duct device and outside the duct device and a cap outlet located outwardly from the second end in the direction of the longitudinal axis. Vertically extending, wind deflecting members are mounted on the duct device and extend horizontally outwardly from the at least one exterior duct wall. These members also extend vertically below the annular cap.

In one preferred embodiment, the wind deflecting members or vanes are flat panels that extend in vertical planes and are distributed substantially evenly and circumferentially about the duct device.

According to another aspect of the invention, an exhaust gas discharging apparatus comprises a duct member forming a single exhaust passage that extends from an open first end to an open second end of the duct member. The duct member has a centrally disposed longitudinal axis extending between the first and second ends and is formed by a duct wall having at least two longitudinally extending bent wall portions that are distributed substantially evenly about the periphery of the duct member which extends about the longitudinal axis. Each bent wall portion projects inwardly towards the longitudinal axis as seen in transverse planes in the region of the second end whereby the bent wall portions gradually and increasingly pinch a single passage in the direction of the second end. An annular cap is connected to the duct member and is disposed about the exterior of and in spaced, substantially co-axial relation to the second end of the duct member. This cap has a cap inlet located between the first end and the second end of the duct member and outside the duct member and a cap outlet located outwardly from the second end in the direction of the longitudinal axis. Vertically extending, wind deflecting members are provided on the duct member and extend horizontally outwardly from the duct wall. These members extend vertically below the annular cap.

In one preferred embodiment, there are only two of the bent wall portions, these being located diametrically opposite one another.

According to another aspect of the invention, an upblast exhaust fan apparatus includes a fan housing having a fan inlet adapted to receive gas or air to be exhausted and a fan outlet to expel the gas or air from the housing. A fan is rotatably mounted within the fan housing and is adapted to draw the gas or air in through the fan inlet and to expel gas or air through the fan outlet. An exhaust gas nozzle is connected to the fan housing at the fan outlet, this nozzle including a duct device having first and second outer wall sections which are oppositely positioned with respect to one another and first and second inner wall sections which are also oppositely positioned with respect to one another. The first outer wall section and the first inner wall section are arranged and joined to each other to form a first passageway and the second outer wall section and the second inner wall section are arranged and joined to each other to form a second passageway. The first and second passageways have respective central longitudinal axes which extend substantially in the same vertical plane. The duct device has an inlet end connected to the fan outlet and defining a nozzle inlet and an outlet end having a first upper outlet formed by the first outer wall section and the first inner wall section and a second upper outlet formed by the second outer wall section and the second inner wall section. A wind band extends circumferentially around the first and second upper outlets and an upper portion of the duct device and this wind band extends vertically. Vertically extending, wind deflecting members are mounted on the outer wall sections and extend horizontally outwardly from the outer wall sections. These members also extend vertically below the wind band.

In a preferred embodiment, the wind band has a frusto-conical shape and forms an annular air gap around the upper portion of the duct device to induce the flow of air from below the wind band to mix with and dilute gases being exhausted from the first and second upper outlets during use of the fan apparatus.

According to still another aspect of the invention, an exhaust gas discharging apparatus comprises a duct member forming a single exhaust passage that extends from an open first end to an open second end of the duct member. A centrally disposed longitudinal axis extends between the first and second ends. The duct member is formed by a duct wall having at least two longitudinally extending bent wall portions that are distributed substantially evenly about the periphery of the duct member which extends about the longitudinal axis. Each bent wall portion projects inwardly towards the longitudinal axis as seen in transverse planes in the region of the second end whereby the bent wall portions gradually and increasingly pinch the single passage in the direction of the second end. A plurality of co-axial, substantially frusto-conical wind bands are mounted on the duct member and are disposed about the exterior of and in spaced co-axial relation to the duct member. These wind bands each have a bottom band end forming a respective wind band inlet and an open top end. The wind bands are arranged one above another in the longitudinal direction of the duct member with the wind band closest to the first end of the duct member having its respective wind band inlet located between the first and second ends of the duct member. All of the wind bands are outside the duct member and the wind band located furthest from the first end of the duct member has its top end located outwardly from the second end of the duct member in the direction of the longitudinal axis.

According to a further aspect of the invention, an exhaust gas discharging apparatus includes a nozzle device for exhausting a high volume of gas or air upwardly from a fan outlet, this nozzle device including a duct unit forming at least one exhaust passage that extends vertically from an open first end to an open second end of the duct unit. The duct unit has a central vertical axis extending between the first and second ends and is adapted for connection to an exhaust fan outlet at the first end. The duct unit also has at least one exhaust gas outlet at the second end. A substantially frusto-conical cap is connected to the duct unit and is disposed about the exterior of and in spaced-substantially co-axial relation to the second end. The cap has an annular cap inlet located between the first and second ends of the duct unit and outside of the duct unit and a cap outlet located above the at least one exhaust gas outlet of the duct unit. Vertically extending wind deflecting vanes are rigidly mounted on the duct unit and extend horizontally outwardly from the duct unit. These vanes extend vertically downwardly from the frusto-conical cap in order to be able to direct cross-winds into the cap inlet.

Further features and advantages will become apparent from the following detailed description taken in conjunction with the accompanying drawings.

DETAILED DESCRIPTION OF PREFERRED EMBODIMENTS

Figure 1:
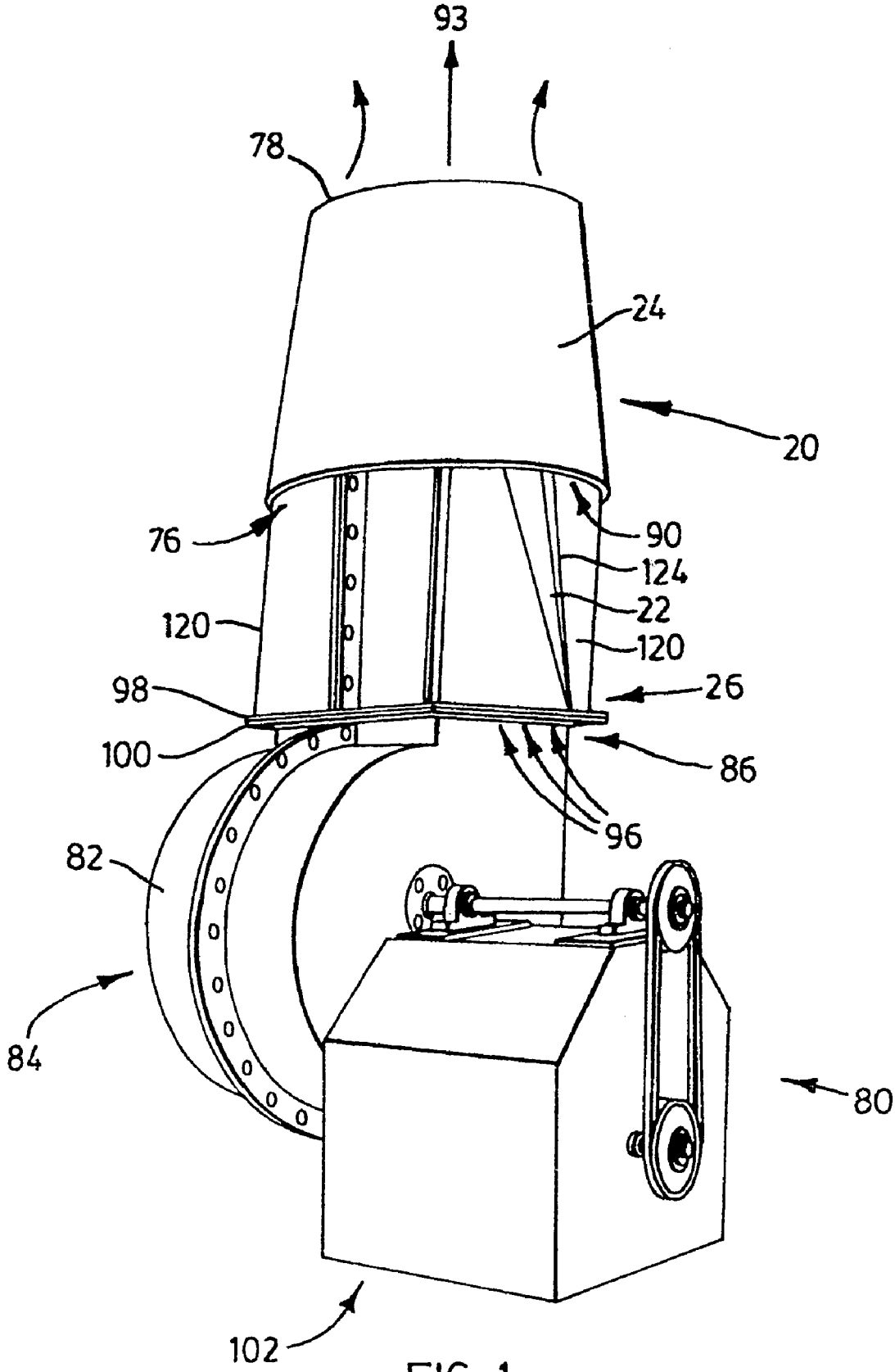
FIG. 1 is a perspective view of a nozzle constructed according to a preferred embodiment of the present invention and operatively mounted on a radial fan apparatus.

With reference to FIG. 1, a first embodiment of the present invention in the form of an improved exhaust gas nozzle 20 is illustrated. The nozzle 20 includes a tubular body member or duct member 22 and an annular cap 24. Except for the differences described hereinafter, the illustrated exhaust gas discharging apparatus of FIG. 1 is similar to that described in applicant's Canadian patent application No. 2,413,627 filed Dec. 6, 2002. As can be appreciated from FIG. 2, the duct member or duct means has an open first or bottom end 26, an open second or top end 28 and a centrally disposed longitudinal axis A extending between the first and second ends. The duct member or duct means forms a single exhaust passage 36 in this embodiment, this passage extending between the first and second ends.

Figure 2:
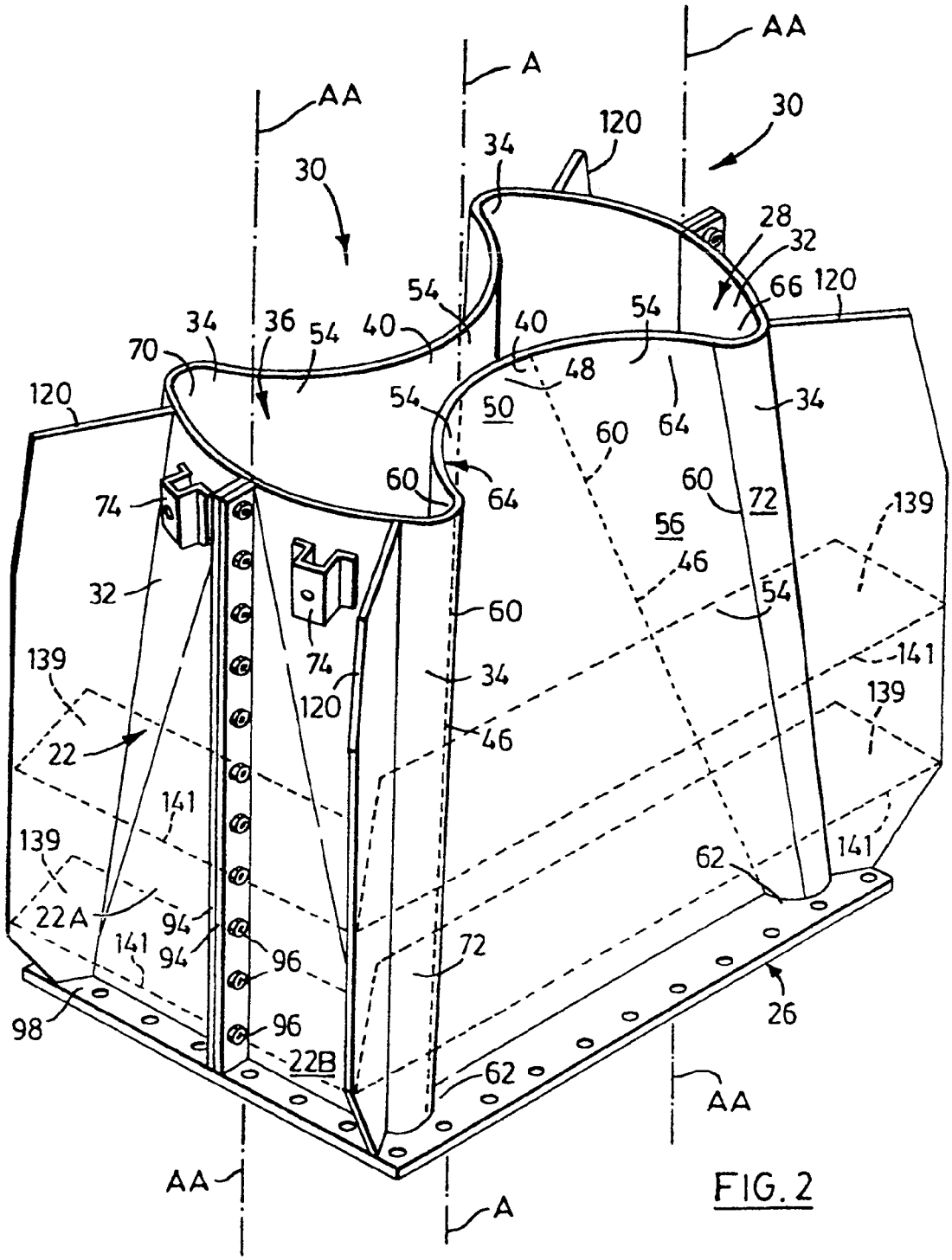
FIG. 2 is a perspective view of the duct member of the K exhaust gas nozzle of FIG. 1.
Figure 3:
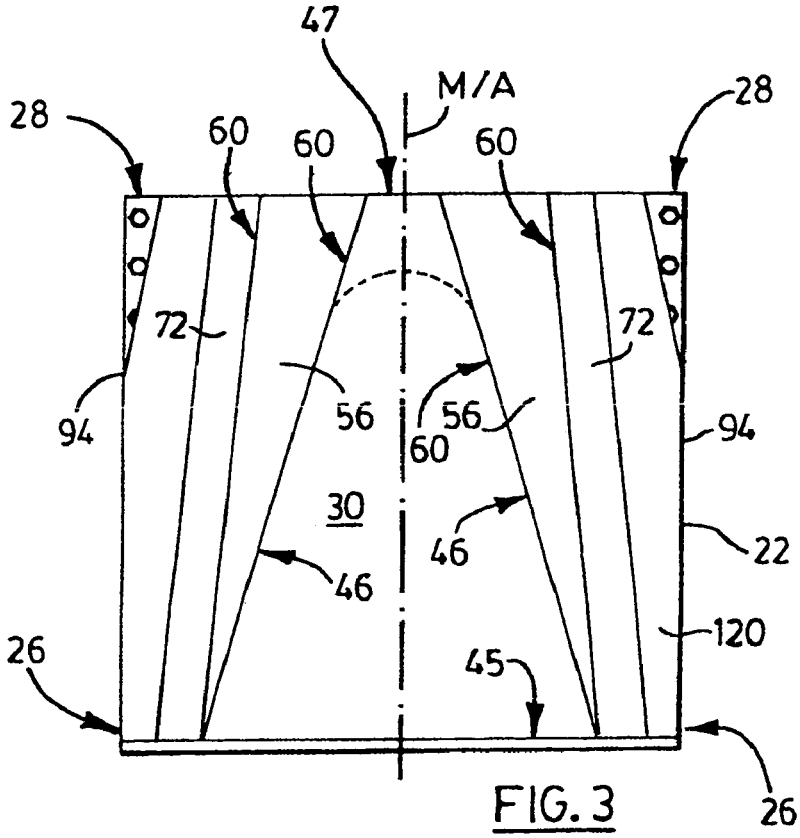
FIG. 3 is a side view along the medial plane of the duct member of FIG. 2.
Figure 4:
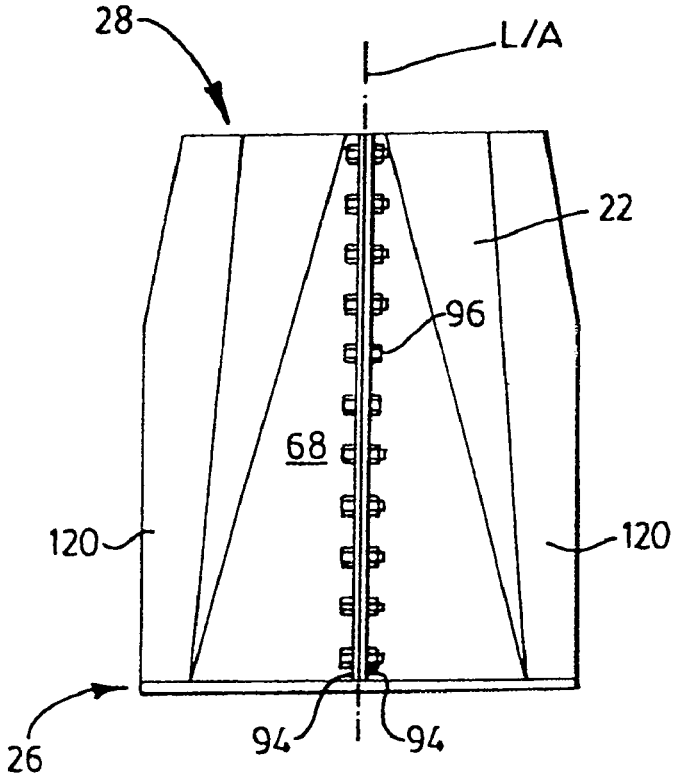
FIG. 4 is a side view along the lateral plane of the duct member of FIG. 2.

A medial plan M indicted in FIG. 3 is parallel to and intersects the longitudinal axis A of the duct member. Also, as indicated in FIG. 4, a central lateral plane L is parallel to and intersects the longitudinal axis A and is perpendicular to the medial plane M. When viewed along the lateral plane L in a direction normal to the longitudinal axis, the duct member 22 tapers in profile from the first end 26 to the second end 28. As visible in FIGS. 2 and 5, the duct member 22 is formed by a duct wall having a pair of flared portions 30 (also referred to herein as "bent wall portions") spaced apart from one another on opposite sides of the lateral plan L and a pair of sidewall portions 32, spaced apart from one another on opposite sides of medial plane M. Each side wall 32 is spaced laterally outwardly from the pair of flared portions 30. A pair of transition portions 34 for each side wall portion connects each side wall portion to a respective one of the pair of flared or bent wall portions 30. In this manner, the bent wall portions 30, the side wall portions 32 and the transition portions 34 collectively define, the single passage 36 for the flow of gases and/or air between the first end 26 and the second end. The bent wall portions 30 are distributed evenly about the periphery of the duct member, that is, the periphery extending about the longitudinal axis A.

The bent wall portions 30 extend from the first end 26 to the second end 28 and gradually and increasingly pinch the passage in the direction of the second end 28 and define therebetween a flow restriction. It can be seen that the duct member collapses inwardly towards the centrally disposed longitudinal axis A in the two regions of the bent wall portions. Each bent wall portion 30 in fact slopes inwardly towards the longitudinal axis A in the direction of the second end 28.

In this embodiment, each bent wall portion 30 comprises a substantially planar central portion extending roughly from the first end to the second end 28 and aligned substantially normal to the medial plane M. The central portion 40 has a first end 45 located at the first end 26 of the body member, a second end 47 located at the second or top end 28 and a pair of side edges 46. The central portion varies in width, tapering in horizontal dimension from the first end 45 to the second end 47. A lip 48 is formed at the top of the central portion, this lip having a concave exterior surface 50.

Each flared or bent wall portion 30 also comprises a pair of elongate, curved perimeter portions located on opposite sides of the central portions. Each of these perimeter portions 54 has a first end 62 adjacent the first end 26 and a second end 64. Each perimeter portion tapers from the second end 64 to the first end 62. The vertically extending sides of the perimeter portions are indicated at 60. The concave exterior face 56 extends between the sides 60. The perimeter portions 54 extend horizontally from the central portion 40 and then turn outwardly away from the central lateral plane L.

The side wall portions 32 each extend from the first end 26 to the second end 28 and they intersect the lateral plane L in substantially lateral relation to define a respective axis AA that lies in the lateral plane L. The side wall portions each have an inner side 66 which is substantially planar and parallel to the medial plane N at the first end 26 and becomes progressively and increasingly concave as the side wall portion 32 extends towards the second end 28. Each transition portion 34 has a concave inside surface and a convex outside surface 72 and combines with the adjacent sidewall portion 32 and the adjacent bent wall portion 30 to provide a smoothly contoured interior surface of the duct member.

The cap or wind band 24, which preferably has a frusto-conical or substantially frusto-conical shape, is connected to the duct member by brackets 74 and is disposed about the exterior of and in spaced substantially co-axial relation to the second end 28 of the duct member. The annular cap 24 has a cap inlet or open end 76 located between the first end and the second end of the duct member and outside the duct member and a cap outlet 78 located outwardly from or above the second end in the direction of the longitudinal axis A. The preferred, illustrated cap tapers in diameter towards the cap outlet 78.

Figure 6:
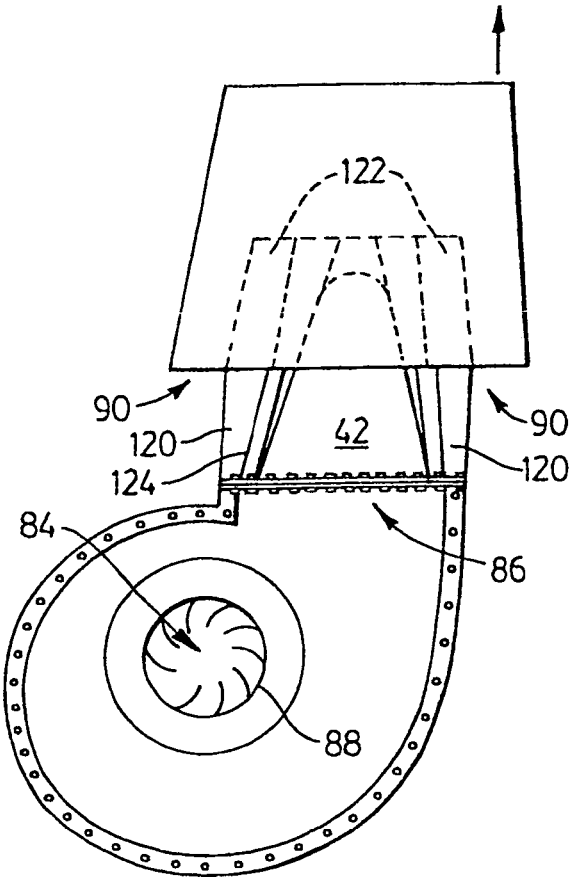
FIG. 6 is a side view along the medial plane of the exhaust gas nozzle and radial fan of FIG. 1.

In FIGS. 1 and 6 the exhaust gas discharging apparatus of the invention is illustrated along with the fan apparatus 80. The fan apparatus includes a fan housing 82 having a fan inlet 84 to receive gas or air to be exhausted and a fan outlet 86 to expel gas or air. Also, provided is a radial or centrifugal fan 88 rotatably mounted within the fan housing and adapted to draw exhaust gas or air in through the fan inlet 84 and to expel this gas out through the fan outlet. The radial fan is connected to and driven by an external motor 102. With reference to FIGS. 1 and 2, a flange 98 is provided at the first end 26 of the duct member and this flange is joined by nut and bolt assemblies 96 to a mating flange 100 provided on the fan housing.

It will be understood that the open first end 26 of the duct member can be connected in sealed fluid communication with the fan outlet 86 so that exhaust gas can be drawn in through the fan inlet and expelled through the fan outlet and then through the nozzle 20. It is thus propelled upwardly into the atmosphere as shown by the arrow 93 is FIG. 1. Such action causes ambient air to be induced into the cap 24 as shown by arrows 90 to mix with the exhaust gases and therefore to dilute same as they are propelled upwardly. A cap or wind band 24 is known per se in the exhaust gas discharging art and is shown and described, for example, in the aforementioned U.S. Pat. No. 4,806,076.

As described in applicant's Canadian patent application No. 2,413,627 laid open Jun. 13, 2003, various alternative constructions for the duct member of the exhaust gas nozzle are possible. For example, instead of two bent wall portions as illustrated in FIGS. 1 and 2, it is possible to construct the duct member with four bent wall portions. In this version, the connecting flange at the bottom can be square instead of rectangular. As in the above described gas nozzle 20, there is a single passage extending between the opposite ends of the duct member for the flow of the exhaust gases and the bent wall portions gradually and increasingly pinch the passage. The single passage has four spaced-apart and elongate longitudinal channels separated by the bent wall portions.

Another variation of a gas nozzle that can be used in the present invention and that is illustrated and described in applicant's laid open U.S. Pat. No. 2,413,627 is a version having three bent wall portions. Again, in this version, there is a single passage that extends between two opposing ends of the duct member. Three spaced apart and elongate longitudinal channels are formed by this duct member and they gradually restrict the passage towards its upper end.

As illustrated in FIGS. 1, 2, 4 and 5, the preferred gas nozzle 20 is constructed from two similar duct sections or duct parts 22A and 22B that are connected to each other by means of mating flanges 94 which are joined by nut and bolt assemblies 96.

Figure 5:
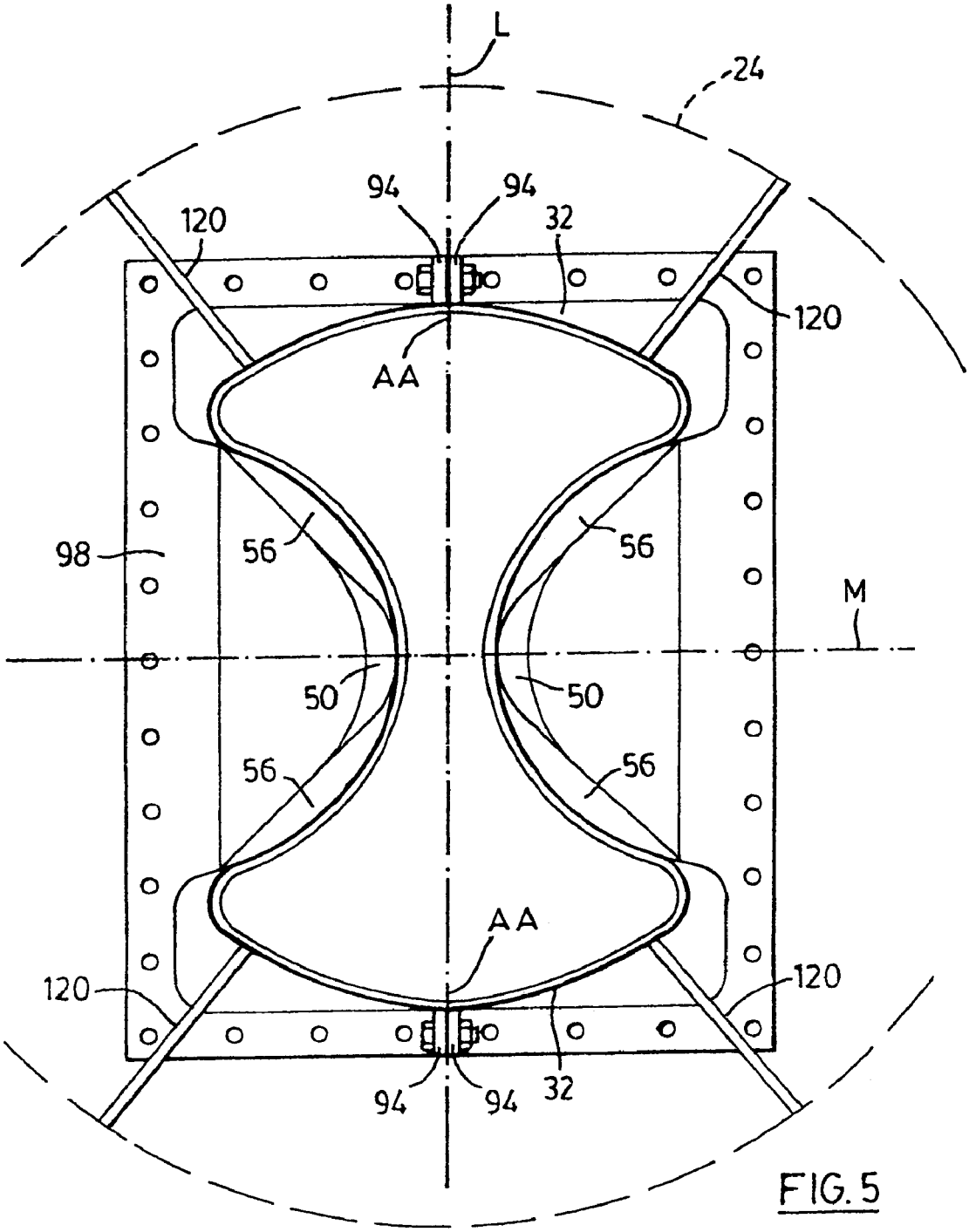
FIG. 5 is a top or plan view of the duct member of FIG. 2.

A significant feature of the present exhaust gas discharging apparatus is the use of vertically extending, wind deflecting members or panels 120 of which there are four in the embodiment of FIGS. 1 to 6. These members are mounted on the duct member 22 and extend horizontally outwardly from the wall or walls of the duct member. As can be seen clearly in FIG. 1, these panels 120 also extend vertically below the annular cap 24. The panels are rigidly connected to the exterior of the duct wall by any suitable known means, for example, by welding, bonding or by the use of suitable fasteners together with connecting flanges and holes for these fasteners. The illustrated preferred panels 120 extend the length of the gas nozzle, that is, from the bottom end 26 to the top end 28. The preferred illustrated panels are flat panels that can be made of a suitable metal or a rigid plastics material or fiberglass and the preferred panels extend in vertical planes and are distributed substantially evenly and circumferentially about the duct member 22. As shown in FIG. 5, for example, there are four panels 120, with one located at each of the four corners of the gas nozzle. In the preferred embodiment, the panels 120 extend not only up to the cap inlet 76 but also into the annular cap where they can be used to connect the cap to the duct wall, if desired. Upper portions 122 of the members 120 that connect the inside of the cap to the exterior of the duct member are indicated in dash lines in FIG. 6. In the preferred arrangement of FIG. 5, there are a pair of panels 120 extending outwardly from each sidewall portion 32 and, as shown, they can project beyond the adjacent edge of the flange 98. In the illustrated arrangement, each panel of each pair is located near a respective end of the side wall portion. The inner vertical edge 124 of the preferred panel 120 is rigidly connected to the wail of the duct member along the entire length of the duct member.

Figure 7:
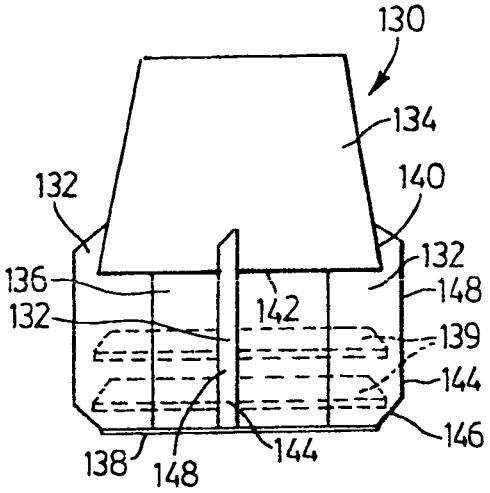
FIG. 7 is a schematic side view of another embodiment of exhaust gas nozzle constructed in accordance with the invention and equipped with horizontally projecting vanes.
Figure 8:
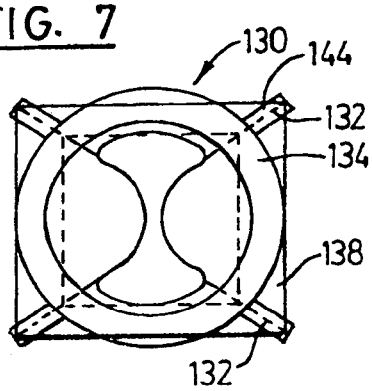
FIG. 8 is a top view of the exhaust gas nozzle of FIG. 7.

An optional feature of the exhaust gas discharging apparatus is the use of horizontally extending guide vanes 139, one version of which is illustrated in FIGS. 2, 7 and 8. These vanes or deflectors are shown in dash lines in FIGS. 2 and 7 to indicate that they are optional and need not always be used. These vanes are straight and elongate in this embodiment and they extend between and are connected at their ends to the adjacent panels 120. Each of these vanes 139 slopes upwardly and inwardly towards the longitudinal axis A. Preferably they are sufficiently rigid to prevent their vibration under strong wind conditions. In the illustrated embodiment there are two guide vanes 139 on each side of the duct member arranged one above the other but there could be as few as one on each side or more than two guide vanes on each side, the number depending to some extent on the overall size of the apparatus. Also, although the illustrated duct member of FIGS. 2, 7 and 8 has guide vanes on all four sides, it is also possible to only have these vanes on two opposite sides of the duct member, in particular the two sides having the bent wall portions 30 formed therein. The guide vanes slope upwardly from their outer longitudinal edge 141.

FIGS. 7 and 8 illustrate an alternative construction for the wind deflecting panels mounted on exhaust gas discharging apparatus 130. It will be understood that apart from the construction of the wind deflecting panels 132, the construction of the apparatus 130 is similar to that illustrated in FIGS. 1 to 5 and described above. The apparatus 130 includes a frusto-conical cap or windband 134 and a duct member 136, the upper end of which extends into the wind band. A mounting flange 138, which can be square as illustrated, is provided on the bottom end of the duct member. In this embodiment, not only do the wind deflecting panels extend vertically below the bottom of the wind band, but they also extend a short distance up the outer side of the wind band as indicated at 140. The preferred illustrated panels 132 are flat panels that extend upwardly from the connecting flange 138 to a point above the bottom end 142 of the wind band. In order for the wind deflecting vanes to deflect the crosswind more effectively into the inlet of the wind band, an edge flange member or edge band 144 extends the external height of each panel 132 and it can include an upwardly and outwardly sloping portion 146 and a vertically extending portion 148.

Figure 9:
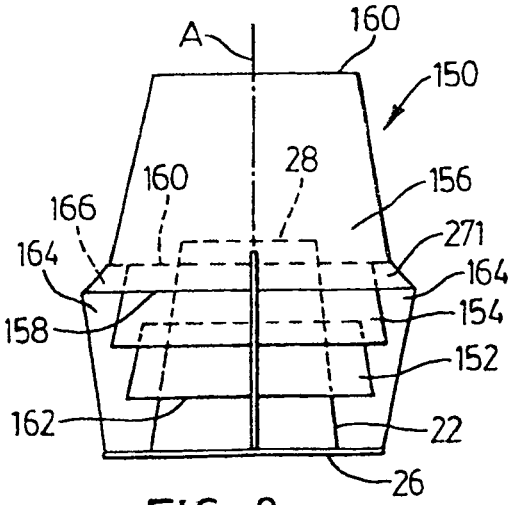
FIG. 9 is a schematic side view of a further embodiment of exhaust gas nozzle.
Figure 10:
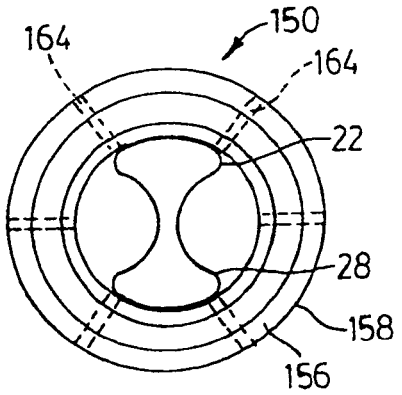
FIG. 10 is a top view of the exhaust gas nozzle of FIG. 9.

FIGS. 9 and 10 illustrate yet another version of an exhaust gas discharging apparatus 150. In this embodiment, the duct member 22 can be similar in its construction to that illustrated in FIGS. 1 to 5 and described above. However, in the apparatus 130, there are a plurality of co-axial, frusto-conical wind bands mounted on the duct member 22. In the particular illustrated embodiment, there are three such wind bands indicated at 152, 154 and 156. The top wind band, which is much larger than the other two, can also be called a cap. These wind bands are disposed about the exterior of and in spaced co-axial relation to the duct member 22. Each wind band has a bottom band end 158 forming a respective band inlet and an open top end 160. As shown in FIG. 9, the wind bands are staggered relative to one another in the longitudinal direction of the duct member. The wind bands can also be described as being arranged one above another in the longitudinal direction of the duct member. The lowest wind band 152 closest to the first or bottom end of the duct member 22 has its band inlet 162 located between the first end 26 and the second end 28 of the duct member. All of the wind bands 152, 154 and 156 are outside the duct member 22 and the cap 156 furthest from the first end 26 of the duct member has its top end 160 located outwardly from the second end 28 of the duct member in the direction of the longitudinal axis A'.

In the preferred illustrated embodiment, the windbands 152, 154, 156 have a substantially frusto-conical shape and they vary in their diameter from each other, both at their bottom band ends 158 and their top ends 160 with the smallest diameter wind band 152 being located closest to the first end 26 of the duct member. It will also be appreciated that each wind band above the bottommost wind band can be connected rigidly to and mounted on the wind band immediately below it. This can be done by radially extending bracket members (not shown) that extend from the interior surface of the upper wind band to the exterior of the next lower wind band.

The exhaust gas discharging apparatus 150 is also preferably provided with wind deflecting panels 164 extending in the direction of the longitudinal axis A' and extending horizontally outwardly from at least the duct member 22. The panels 164 (which can be four in number as in the previous embodiments or six as shown in FIG. 10) at least extend longitudinally from the lower wind band 152 (that is, the wind band closest to the first end 26 of the duct member) towards the first end 26. In the preferred illustrated embodiment, the panels 164 extend upwardly to at least the bottom end 158 of the uppermost wind band or cap 156 so that the panels have a good ability to deflect crosswinds into the inlets of each of the wind bands. As illustrated, each panel has an inner section 166 that connects the top of the panel to the upper wind band 156. Also, as with the panels 120, it is possible for the panels 164 to extend into the frusto-conical wind bands and to connect these wind bands to either the duct member 22 or the exterior of the adjacent wind band. It will be appreciated that by using a plurality of wind bands, the ability of the exhaust gas discharging apparatus to induce ambient air to mix with the gases exhausting from the duct member can be enhanced. The two lower wind bands 152 and 154 serve substantially the same purpose as the straight guide vanes 139 and therefore these curved wind bands can also be termed guide vanes. It will be understood that each of the wind bands 152, 154 is made up of curved sections that extend between and are connected to the vertical panels 132.

Figure 11:
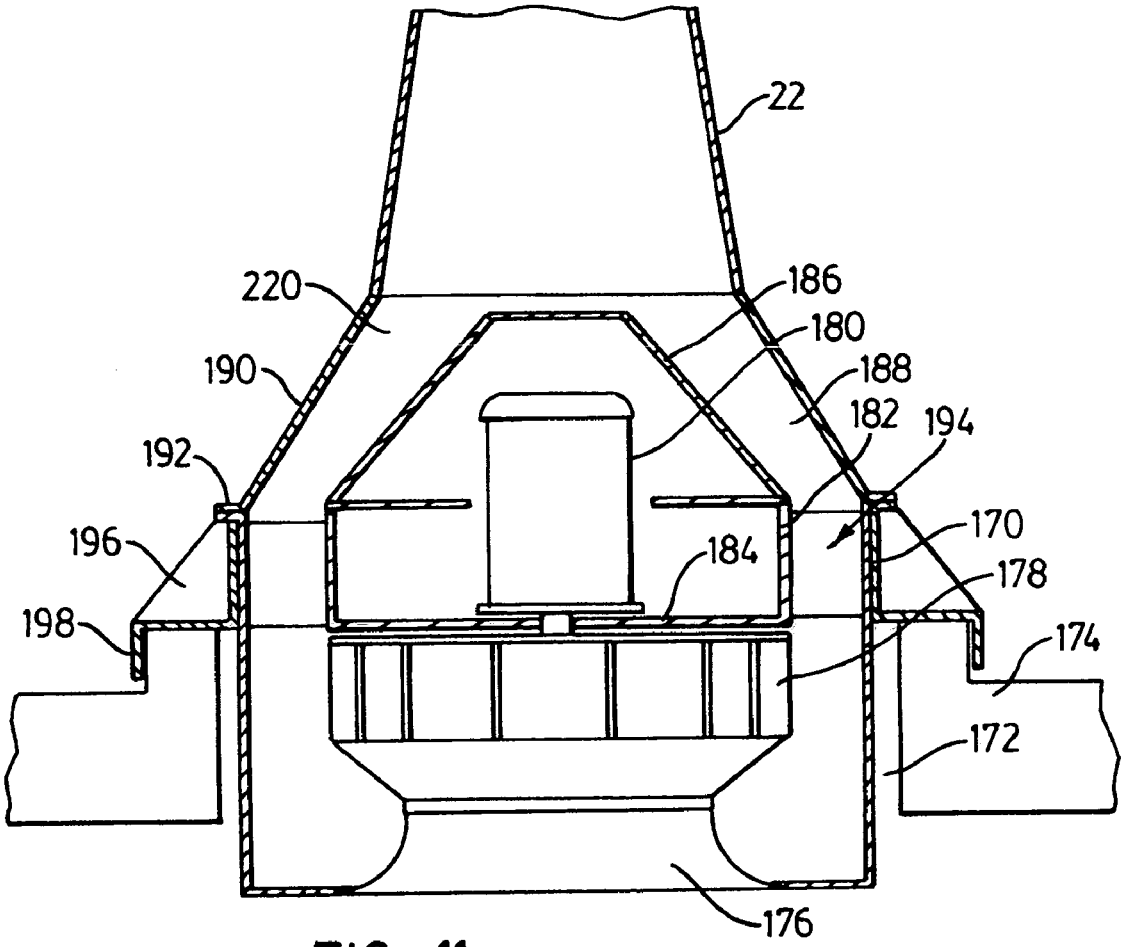
FIG. 11 is a schematic, vertical cross-sectional view taken along the longitudinal axis of the exhaust gas nozzle, this view illustrating an alternative form of fan wheel arrangement for expelling exhaust gases through the nozzle.

FIG. 11 illustrates an alternative form of fan construction that can be used in combination with the exhaust gas discharging apparatus of the invention. A duct member 22 constructed in accordance with the invention is mounted directly above a fan housing 170 which can have a cylindrical shape and which is adapted for mounting in a circular hole 172 formed, for example, in a roof 174 of a building, for example, an industrial building wherein polluted or noxious gases are produced. In the bottom of the fan housing, a circular fan inlet 176 is provided and rotatably mounted above this inlet is a fan wheel or centrifugal fan 178 that rotates about a vertical axis. The fan wheel can be driven by an electric motor 180 which in one embodiment of this exhaust gas fan system is a ten horsepower motor capable of rotating the fan at 1200 rpm, the fan having a diameter of about three feet. The motor 180 is enclosed in a motor housing 182 which has a horizontal bottom 184. The drive shaft of the motor extends through a hole in the bottom 184 and is connected to the center of the fan wheel 178 in order to rotate same. A domed top 186 extends over the top of the motor and the top 186 can be a square/round transition section with the bottom end being round and the top square. An annular and converging gas passageway 188 extends around the top 186. The duct member 22 is mounted on top of another square/round transition section 190. Again, the bottom end of the transition section 190 is round and is fitted with connecting flange 192. The flange or flanges 192 connect the bottom end of the transition section to the fan housing 170. The fan housing 170 is connected to the motor housing 182 by means of radially extending supports or vanes 194 that do not interfere with the upward airflow from the fan. The fan housing 170 is supported on the roof by means of support brackets 196 which can be formed with downwardly extending connecting flanges 198.

It will be appreciated that the duct member 22 shown only in part and schematically in FIG. 11 is fitted with an annular cap 24 and vertically extending, wind deflecting panels (not shown) mounted on the duct member and extending horizontally outwardly from the duct member.

Turning now to the exhaust gas nozzle illustrated in FIGS. 12 to 15, this form of exhaust gas nozzle can also be used in an exhaust gas discharging apparatus constructed in accordance with the invention. This type of exhaust gas nozzle is similar to that illustrated and described in U.S. Pat. No. 4,806,076 issued Feb. 21, 1989 and, accordingly, a detailed description herein is deemed unnecessary. This form of exhaust gas nozzle is indicated generally at 200. It will be understood that the nozzle 200 can be connected to a fan housing at the fan outlet, for example, a fan housing similar to that illustrated in FIG. 11. The gas nozzle 200 includes duct means or duct member 202 with first and second outer wall sections 204 and 206. These outer wall sections are positioned opposite to one another. The duct member also includes first and second inner wall sections 208 and 210 which are also oppositely positioned with respect to one another. The first outer wall section 204 and the first inner wall section 208 are arranged and joined to each other to form a first passageway 212. Also, the second outer wall section 206 and the second inner wall section 210 are arranged and joined to each other to form a second passageway 214. The first and second passageways 212 and 214 have respective central longitudinal axes which extend substantially in the same vertical plane. The duct member 200 has an inlet end at 216 which is connected to the fan outlet, for example, the outlet 220 in the embodiment of FIG. 11. The fan inlet 216 in effect defines a nozzle inlet for an upblast exhaust fan. The duct member also has an outlet end having a first upper outlet 222 formed by the first outer wall section and the first inner wall section and a second upper outlet 224 formed by the second outer wall section 206 and the second inner wall section 210. It will be appreciated by those skilled in the art that a windband such as the windband 24 of FIG. 1 can extend circumferentially around first and second upper outlets 222 and 224 and an upper portion of the duct member 202 and this windband extends vertically and can be frusto-conical in shape so as to taper in an upwards direction.

Figure 12:
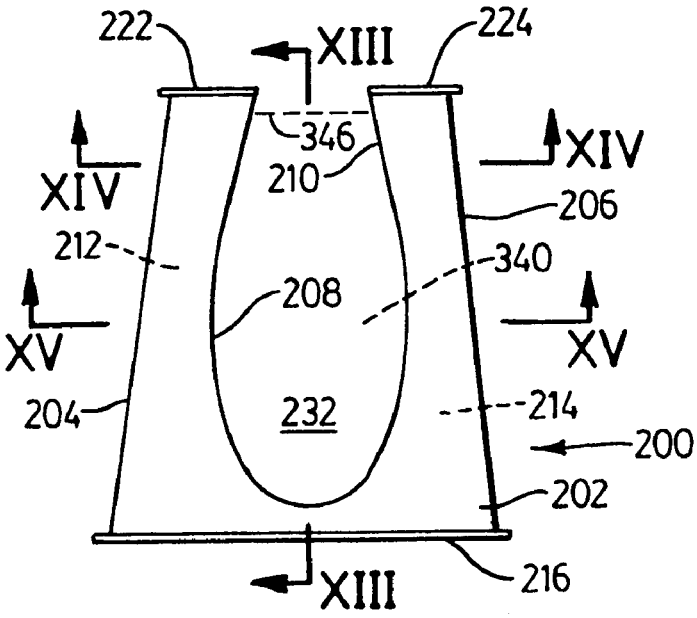
FIG. 12 is a side view of an alternate form of exhaust gas nozzle which can be used in an exhaust gas discharging apparatus constructed in accordance with the invention.
Figure 13:
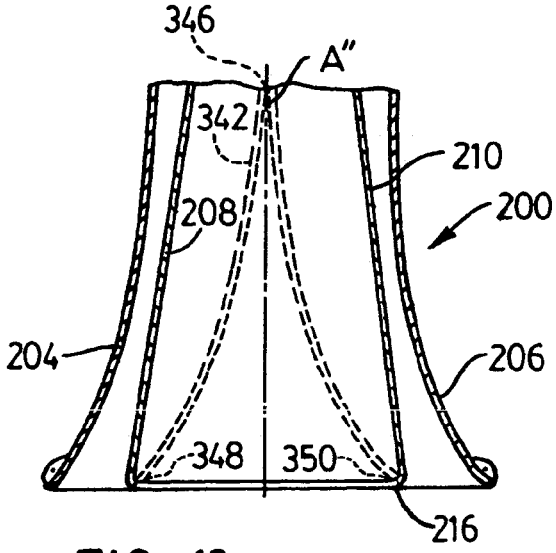
FIG. 13 is a side cross-sectional view of the exhaust gas nozzle of FIG. 12 taken along the line XIII—XIII of FIG. 12.
Figure 14:
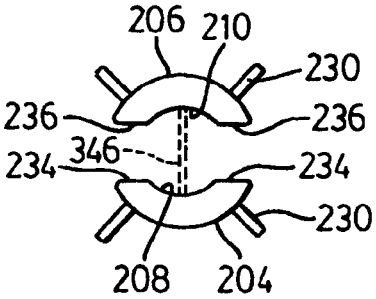
FIG. 14 is a horizontal cross-section of the exhaust gas nozzle of FIG. 12 taken along the line XIV—XIV of FIG. 12.
Figure 15:
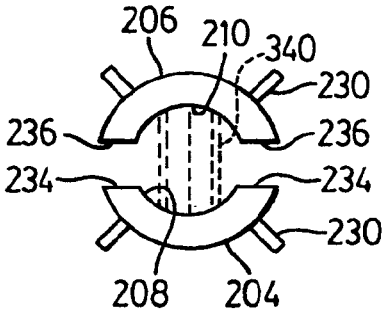
FIG. 15 is another horizontal cross-section of the nozzle of FIG. 12 taken along the line XV—XV of FIG. 12.

Not shown in FIGS. 12 and 13 but shown in FIGS. 14 and 15, are vertically extending, wind deflecting panels 230 which can be similar in their construction to the aforementioned panels 120. The illustrated panels are mounted on the first and second outer wall sections 204, 206 and extend horizontally outwardly from the outer wall sections. As in the first embodiment of the invention illustrated in FIGS. 1 to 5, the panels 230 also extend vertically below the aforementioned wind band mounted on the exhaust gas nozzle 202. In the illustrated upblast exhaust fan apparatus of FIGS. 12 to 15, there are four of the wind deflecting panels 230 but more or fewer of these panels could be provided, if desired. As illustrated, half of the panels 230 extend outwardly from the first outer wall section 204 and the remaining half of the panels extend outwardly from the second outer wall section 206. As in the first embodiment, the preferred panels 230 extend vertically from the inlet end 216 of the duct member to the aforementioned wind band and, if desired, they can extend into the lower section of the wind band and connect the wind band to the duct member 202.

Again, in an upblast exhaust fan apparatus employing the nozzle member of FIGS. 12 to 15 and employing a wind band, the annular gap around the upper portion of the duct member 202 can induce the flow of air from below the wind band to mix with and dilute gases being exhausted from the first and second upper outlets 222, 224 during use of the apparatus. In addition, with the use of the vertically extending panels 230, these act to catch any crosswind and deflect at least a portion of this crosswind upwardly to improve the induction of air through the annular gap. It will also be appreciated that an exhaust gas discharging apparatus using a duct member as shown in FIGS. 12 to 15 can also optionally be provided with one, two or more wind bands below the top wind band or cap in a manner similar to wind bands 152 and 154 shown in FIG. 9.

In the duct member 202 of FIGS. 12 to 15, the first and second outer wall sections 204 and 206 are concave towards each other as are the first and second inner wall sections. Also, the duct member 202 has a centrally disposed longitudinal axis A" that extends between its first or bottom end and the second or top end of the duct member. In this embodiment, there are at least two duct walls including first and second outer wall sections 204 and 206 which form at least two longitudinally extending bent wall portions that are distributed evenly about the periphery of the duct member. Each of these bent wall portions formed by the wall sections 204 and 206 slopes inwardly towards the longitudinal axis A" in the direction of the second end.

Also, in the version of FIGS. 12 to 15, there is a so called passive zone section 232. This passive zone supplies air for mixing by induction into the contaminated or exhaust air that flows out of the two upper outlets. The passive zone section is defined by the first inner wall section 208 which is shaped as a conical section and the second inner wall section 210, also shaped as a conical section that is convex facing outwardly. As shown in FIGS. 14 and 15, there are two vertically extending end walls 234 which extend between the first inner wall section 208 and the first outer wall section 204. Similarly, there are two second end walls 236 which extend between the second inner wall section 210 and the second outer wall section 206 which further define the second exhaust flow path.

An optional improvement to the nozzle member 202 is a central wind deflecting device or partition 340 indicated in dash lines in FIGS. 12 and 15. The partition 340 is rigidly mounted between and extends between the first and second inner wall sections 208, 210. This partition prevents any wind from simply passing horizontally through the passive zone section 232. Instead, any such wind will be deflected upwardly by the partition so that it mixes with the exhaust air flowing out of the two nozzle outlets. Preferably the partition 340 includes two back-to-back curved panels 342, 344 each of which curves upwardly and inwardly towards the central vertical axis A" of the nozzle. Upper edges of these panels meet at a top edge 346. Bottom edges 348, 350 of these panels are spaced apart as shown in FIG. 13 and can respectively be located at or adjacent the bottom edges of inner wall sections 208, 210.

It will also be appreciated that with the nozzle member 202, it is possible to modify this construction to have more than two vertical flow paths and thus, more than two contaminated air outlets. It will be understood by those skilled in the art that the illustrated vertical flow paths and the inner and outer walls forming same can be divided into multiple sections such that any number of individual upper flow paths can be defined and positioned circumferentially about the passive zone.

An exhaust fan apparatus using a nozzle member similar to the nozzle member 202 illustrated in FIGS. 12 to 15 is also shown and described in the aforementioned U.S. Pat. No. 5,439,349. The vertically extending, wind deflecting panels and the horizontally extending guide vanes (preferably in the form of curved lower wind bands) described above can also be incorporated into the exhaust fan apparatus described in this U.S. patent specification.

Figure 16:
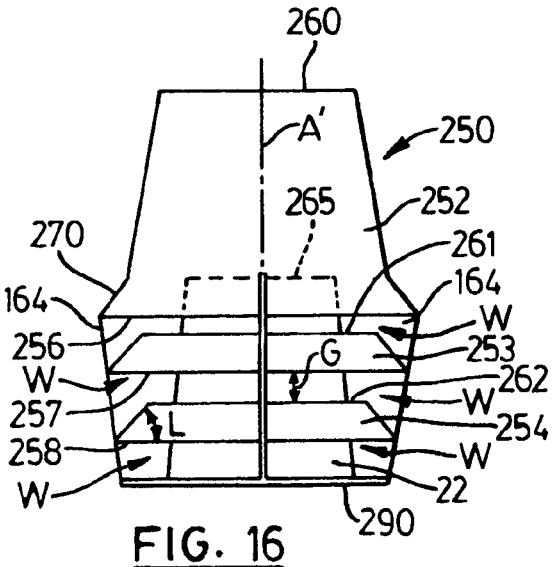
FIG. 16 is a schematic side view of a further embodiment of exhaust gas nozzle.
Figure 17:
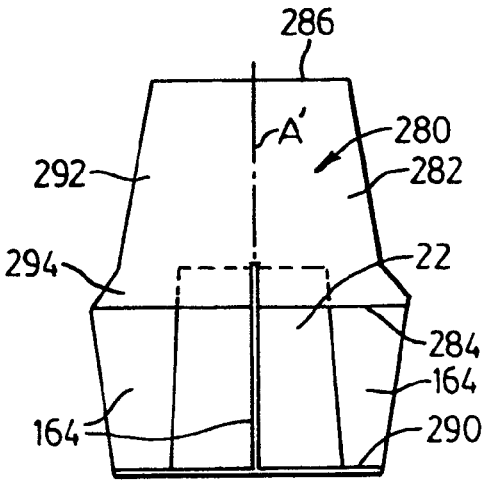
FIG. 17 is another schematic side view of yet another embodiment of an exhaust gas nozzle constructed according to one aspect of the invention.

FIGS. 16 and 17 illustrate additional possible versions of an exhaust gas discharging apparatus instructed in accordance with one or more aspects of the invention. The exhaust gas discharging apparatus 250 of FIG. 16 is somewhat similar to the embodiment of FIG. 9 in that the apparatus is provided with a plurality of wind bands which are arranged one above the other. These wind bands 252 to 254 are co-axial and frusto-conical or substantially frusto-conical in shape. In the particular illustrated embodiment of FIG. 16, there are three of these wind bands with the upper wind band or cap 252 being substantially larger than the two lower wind bands 253, 254. The wind bands are disposed about the exterior of and in spaced, co-axial relation to the duct member 22.

These wind bands have bottom ends forming three wind band inlets 256 to 258. The wind bands also have open top ends indicated at 260 to 262. As in the embodiment of FIG. 9, all of the wind bands are located outside of the duct member 22 and the upper wind band 252 has its top end 260 located outwardly from the second or top end of the duct member 22 in the direction of the longitudinal axis. The top end 265 of the duct member 22 in the illustrated embodiment is indicated in dash lines and is substantially below the top end 260 of the cap or wind band 252.

It will also be seen that in this embodiment the bottom end of each of the upper wind bands 252, 253 is above the top end of the next lower wind band. In other words, in this embodiment, the three wind bands do not overlap and in fact there is a short gap in the longitudinal direction between the adjacent wind bands. This gap being indicated at G for the wind bands 253 and 254. Also each of the lower wind bands 254, 253 slopes upwardly and inwardly around its circumference from its bottom end to its top end. Although the amount of the slope can vary, the preferred illustrated slope is approximately 45 degrees to horizontal or, stated another way, 45 degrees to the vertical longitudinal axis A'. By increasing the slope angle in this manner, the effective size of the annular inlet formed by each wind band and the outer surface of the duct member is increased and thus the amount of outside or atmospheric air that can be drawn in and through the wind band is increased as compared to a wind band having the same size annular outlet with a slope which forms a smaller angle to the longitudinal axis A'. A bottom section 270 of the upper wind band can also be provided with a slope corresponding to that on the lower wind bands. The bottom section 271 of the cap 156 shown in FIG. 9 also slopes outwardly at a greater angle to the axis A' than the remaining upper section of the cap. As in the above described exhaust gas discharging nozzles, the apparatus 250 is also provided with vertically extending wind deflecting panels that can be arranged and constructed in a manner similar to the panels 164 described above. The arrows W in FIG. 16 indicate how atmospheric air, which may include a cross wind, can enter into the gas discharge apparatus at several locations each in the form of a substantially annular air inlet formed by one of the wind bands.

Turning to the embodiment of FIG. 17, this exhaust gas discharging apparatus 280 is similar to the apparatus 250 except that it has only a single annular cap or wind band 282. This cap can have the same substantially frusto-conical shape as the upper wind band 252 of the apparatus 250. Again, the duct member 22 can be similar in its construction to that illustrated in FIGS. 1 to 5 and described above. The wind band 282 is disposed about the exterior of and in spaced, co-axial relation to the second or upper end of the duct member 22. The wind band has a bottom end 284 forming an annular inlet and an open top end 286. It will also be seen that this apparatus is provided with vertically extending panels 164 which extend between the bottom end of the wind band and a full inlet flange 290. As in above described embodiments, the vertical panels 164 can extend into the cap or wind band and can be used to connect the wind band 282 to the duct member 22. It will be understood that the inlet of the duct member 22 in either the embodiment of FIG. 16 or that of FIG. 17 can either be circular or rectangular as required to fit and accommodate the outlet of the adjacent fan unit.

The annular cap 282 has a major upper portion 292 with a frusto-conical shape that tapers in an upwards direction and a minor bottom portion 294. The bottom portion comprises an annular wall section that can be integrally connected to the major upper portion of the cap. This annular wall section tapers upwardly and inwardly from the cap inlet at the bottom end 284. The upward taper of this annular wall section is greater than that of the major upper portion 292. In the illustrated preferred embodiment, the slope angle of the bottom portion 294 is about 45 degrees to the horizontal plane or 45 degrees to the longitudinal axis A' of the gas discharge apparatus. As illustrated, the slope of the major upper portion 292 can be about 80 degrees relative to the horizontal plane. It will be appreciated that the type of cap used in the embodiment of FIG. 17 can also be used in combination with the duct unit illustrated in FIGS. 12 to 15 with beneficial results.

Figure 18:
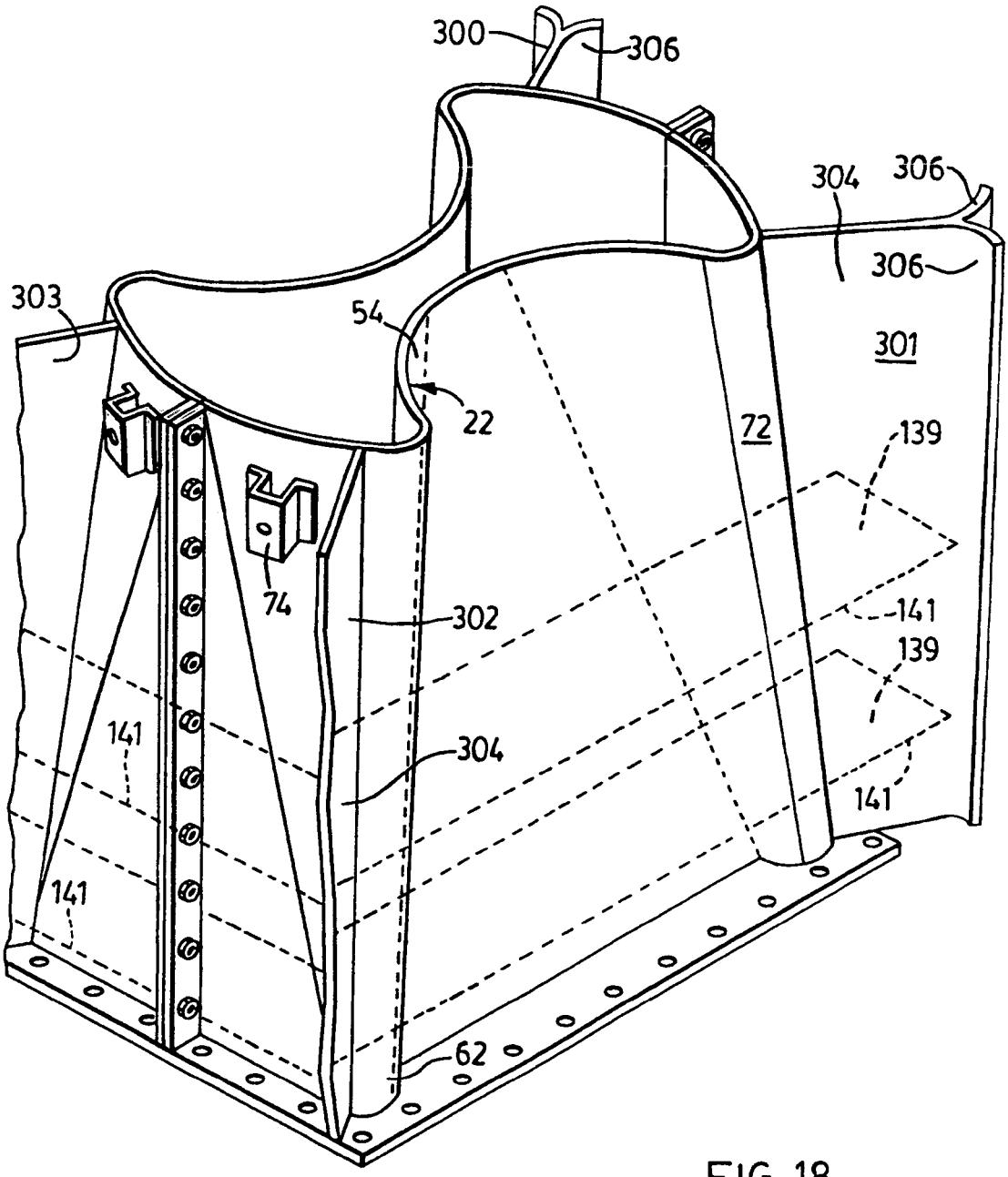
FIG. 18 is another perspective view, partly cut-away for ease of illustration, showing a further embodiment of the exhaust gas nozzle.
Figure 19:
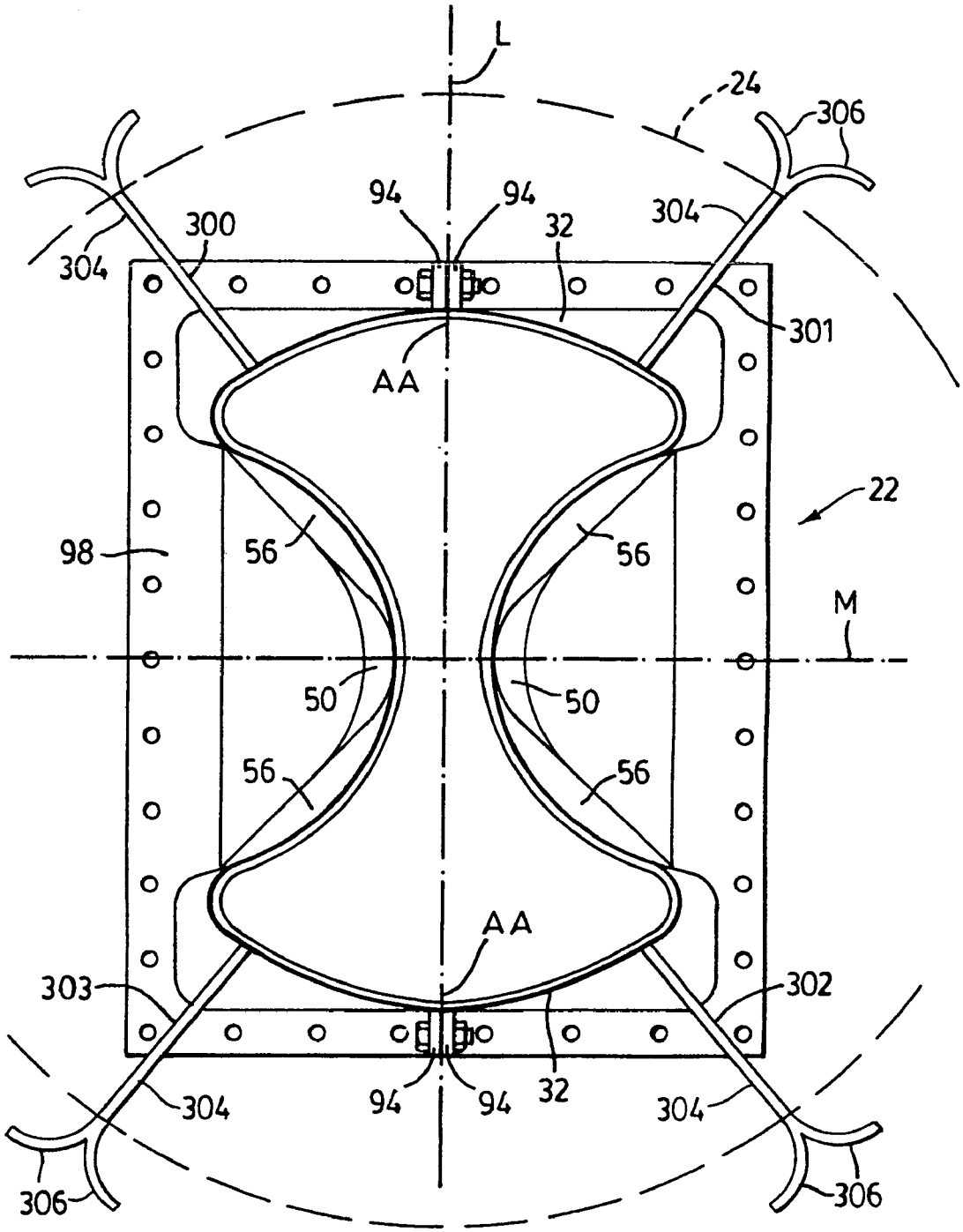
FIG. 19 is a top plan view of the nozzle of FIG. 18.

An alternate form of duct member 22' is illustrated in FIGS. 18 and 19 of the drawings and this duct member is similar to the duct member illustrated in FIGS. 2 to 5 of the drawings, except for the construction of the wind deflecting members. As illustrated, there are four vertically extending wind deflecting members 300 to 303, with only the members 300 and 301 being shown in full in FIG. 18 for ease of illustration. The primary difference between the wind deflecting members or panels 120 of the embodiment of FIG. 2 and the wind deflecting members 300 to 303 is that the latter are not simply flat panels. Instead, each of the wind deflecting members 300 to 303 has a substantially flat inner section 304 located adjacent the duct member 22' and connected rigidly thereto. The flat inner section 304 extends along the vertical length of the duct member and in one preferred embodiment it extends the entire length thereof. Also, each member 300 to 303 has at least one curved outer section 306 and preferably two of these curved outer sections curving in opposite directions as seen in a horizontal plane. The or each curved outer section extends horizontally outwards from the respective flat inner section 304. As shown in FIGS. 18 and 19, each outer section is curved in horizontal cross-sections of the wind deflecting member. The amount of curvature in the outer section 306 can vary but the curve can extend through 90 degrees as illustrated in FIG. 19 or the amount of the curve can be less. An advantage that may be gained with the use of these curved wind deflecting members 300 to 303, which can also be referred to as hooked deflectors, is that they may improve the capture of crosswinds that may exist. In other words, these curved or hooked deflectors may, in some cases, deflect additional outside air along the outside of the duct member in an upward direction and through the exhaust gas discharging apparatus for improved performance. Of course, it will be appreciated that it is not necessary for the curved outer sections 306 to extend into the annular cap of the exhaust gas discharging apparatus. The curved outer sections 306 can be restricted to the sections of the wind deflecting members below the annular cap where these curved sections may help capture a crosswind.

Horizontally extending guide vanes 139 can also be used in conjunction with curved wind deflecting members such as the members 300 to 303. Where guide vanes 139 are used in this version of the gas nozzle, the ends of the vanes 139 can simply be connected to the flat inner sections 304 of the wind deflecting members, or each end of the guide vane 139 can be curved itself to match the curvature in the wind deflecting member 300 to 303 to which it is being connected.

Turning now to the preferred exhaust gas discharging apparatus illustrated in FIGS. 20 to 23, this preferred embodiment is indicated generally by reference 310. This exhaust gas discharging apparatus 310 is similar in its construction to the nozzle 20 as illustrated in FIGS. 1 to 5 of the drawings, except for the differences noted hereinafter. The apparatus includes a duct member 312 and an annular cap 314. In this preferred embodiment, the duct member has four flared portions 316 which can be seen clearly in FIG. 23 and these are separated by four side wall portions 318. A pair of transition portions 320 of each sidewall portion 318 connects each sidewall portion to a respective one of the flared or bent wall portions 316. In this manner, the bent wall portions 316, the side wall portions 318 and the transition portions 320 form a single passage 322 for the flow of gases and/or air between a first end 324 which is open and an open second end 326 of the duct member. It will be appreciated that in this embodiment as well, the bent wall portions 316 are distributed evenly about the periphery of the duct member, that is, the periphery extending about its longitudinal axis. It will also be appreciated that instead of four such bent wall portions, there could be only three or two evenly distributed about the periphery of the duct member.

Figure 21:
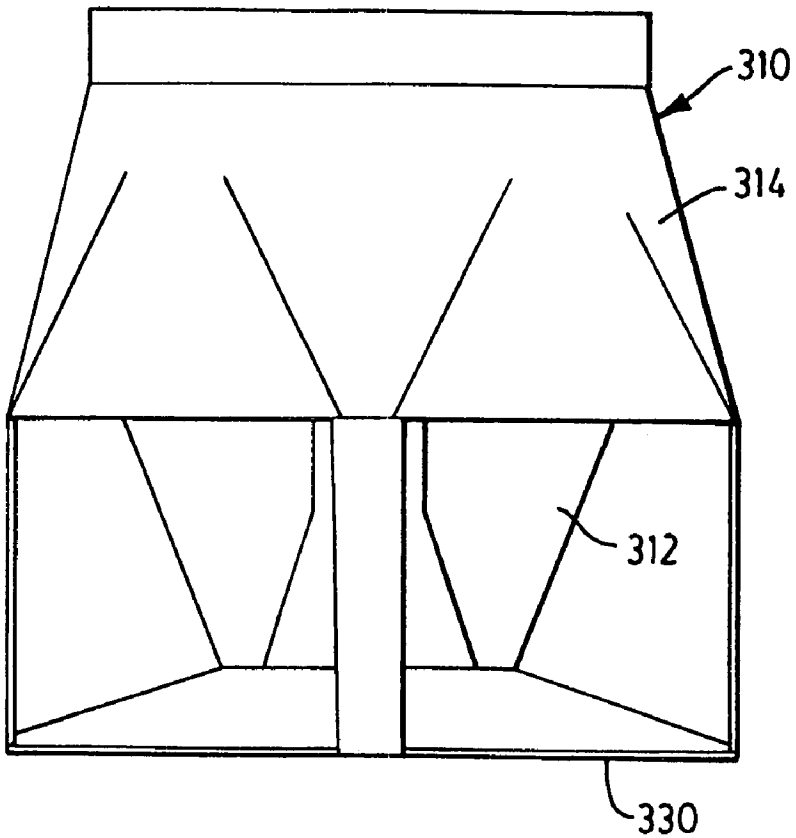
FIG. 21 is a side view taken from one of the four corners of the exhaust gas nozzle of FIG. 20.
Figure 20:
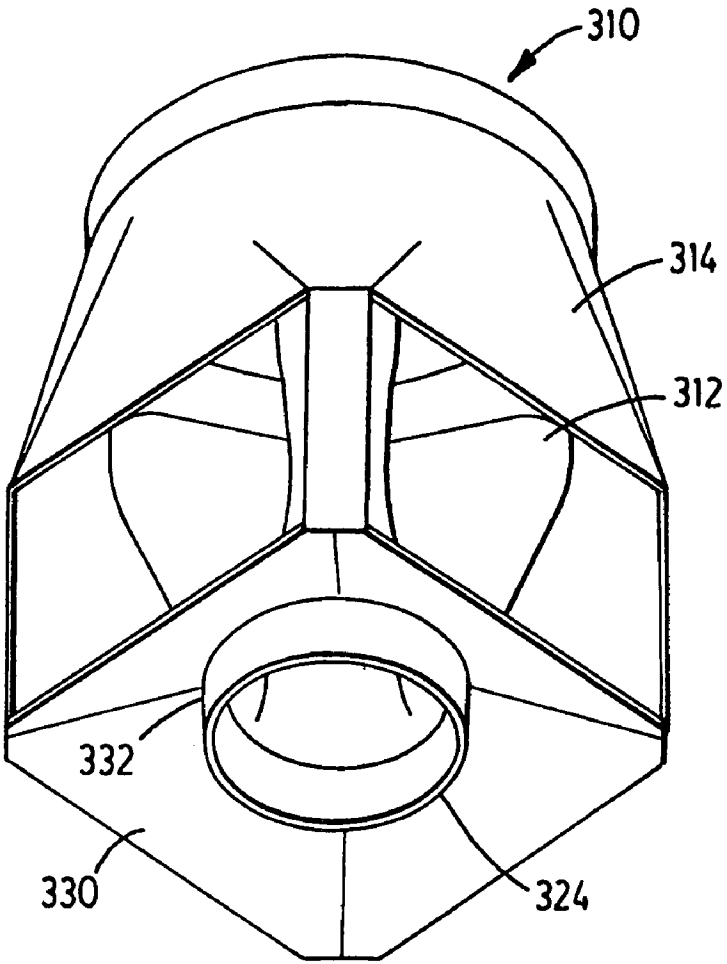
FIG. 20 is an isometric view taken from below and at one of four corners showing a preferred form of exhaust gas nozzle with four bent wall portions and an annular cap.
Figure 22:
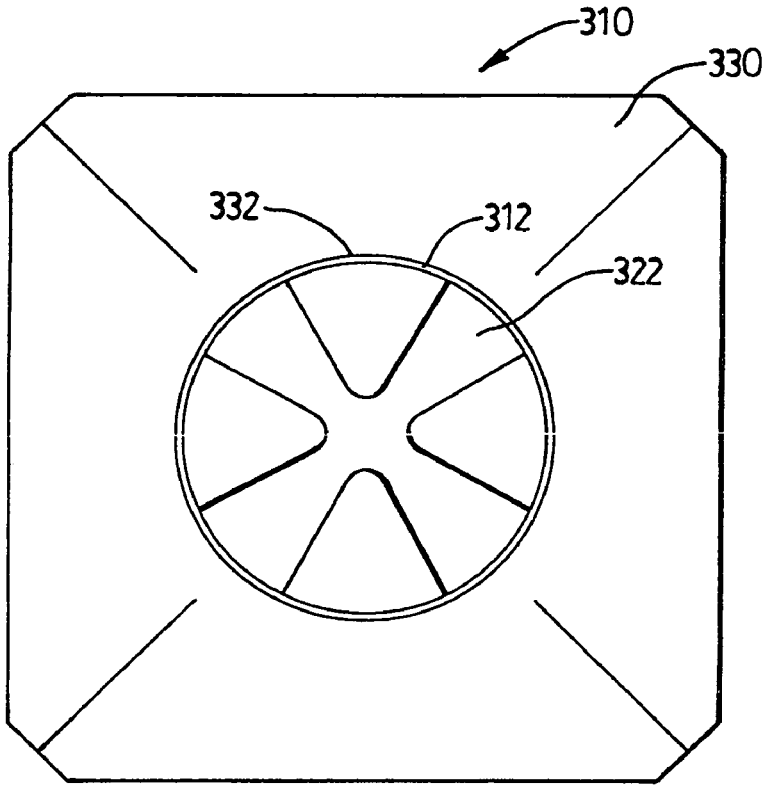
FIG. 22 is a bottom view of the exhaust gas nozzle of FIG. 20, this view showing the round inlet end.
Figure 23:
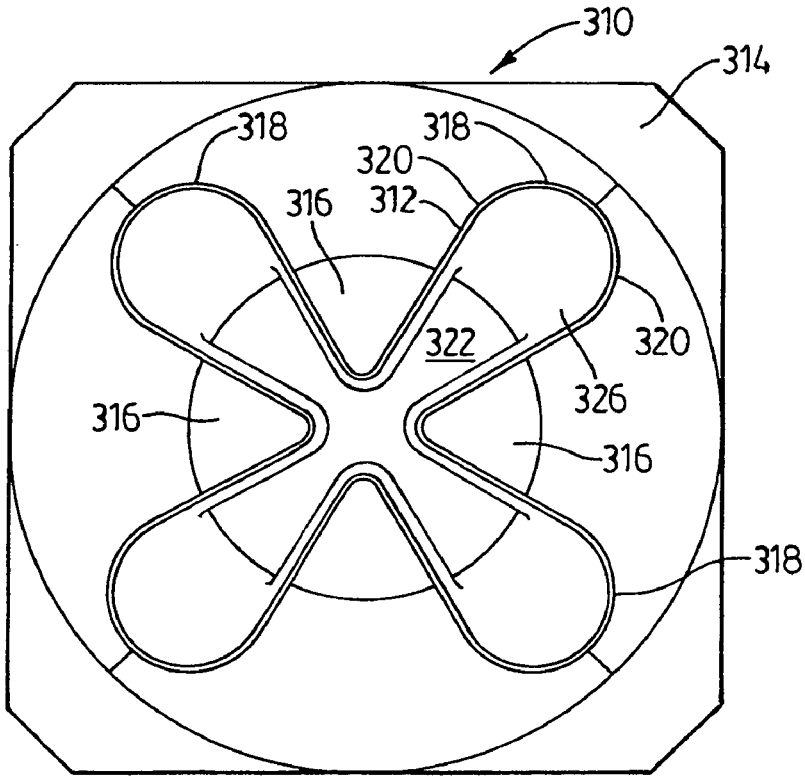
FIG. 23 is a top view of the exhaust gas nozzle of FIG. 20.

An important feature of the exhaust gas discharging apparatus of FIGS. 20 to 23 is the fact that the single passage 322 has a constant or substantially constant area as measured in horizontal cross-section from the first end 324 to the second end 326. The advantage arising from this which will be appreciated by those skilled in this art, is that this provides a constant pressure within the duct member and this can result in a substantially less or no pressure drop in this preferred exhaust gas discharging apparatus. This advantage can be obtained either with the version of the duct member having four bent wall portions 316 as shown or only two or three of these bent wall portions. Moreover, it is possible using suitable known fans attached to the inlet of the exhaust gas nozzle to maintain a constant cross-sectional area from the fan outlet through to the top of the duct member of the exhaust gas discharging nozzle and thus maximize the advantage of maintaining a constant pressure in this system. Also shown in FIGS. 20, 21 and 22 is an additional nozzle support plate 330 which plate can be substantially rectangular in plan view as shown in FIG. 22 but the four corners can be cut off, if desired. The support plate is somewhat dish-shaped and is formed with a central circular opening at 332 to accommodate the circular inlet of the duct member of the exhaust gas nozzle. It will be understood that the support plate 330 can be connected by suitable fasteners to a rigid adjacent support structure (not shown) in order to provide good support for the exhaust gas discharging apparatus.

It will be appreciated that the exhaust gas discharging apparatus of FIGS. 20 to 23 can also be provided with the various improvements and features described above including the wind deflecting panels 120 and the horizontally extending guide vanes 139.

Figure 24:
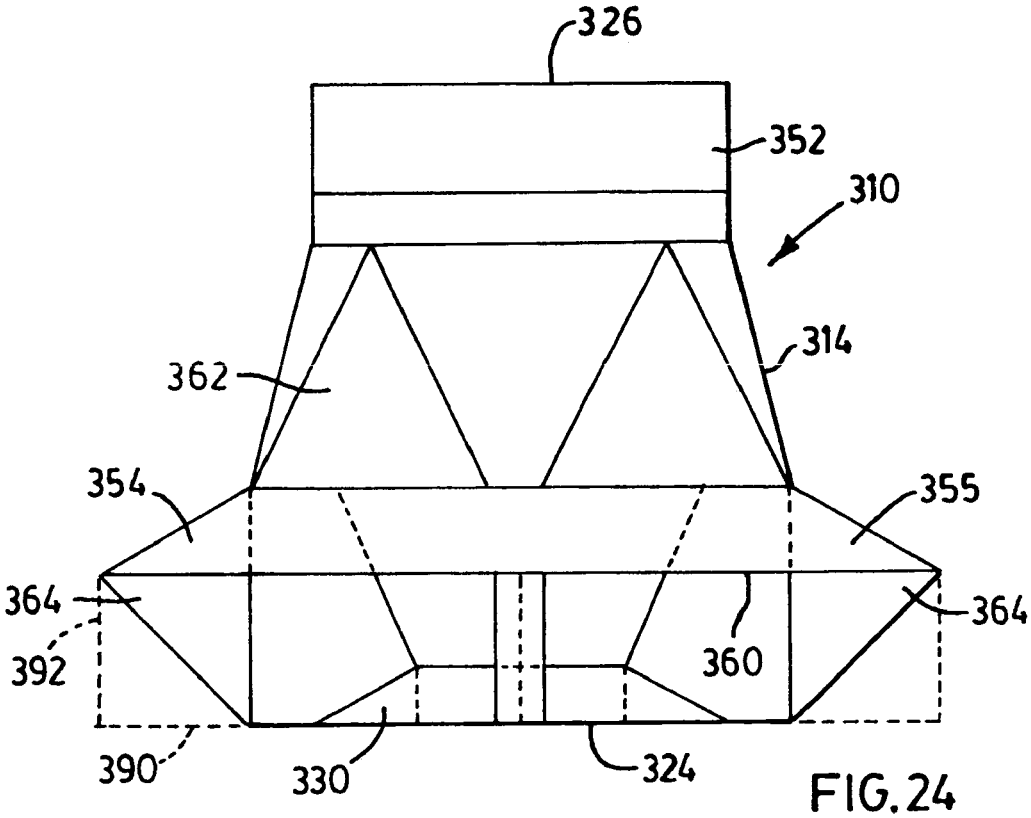
FIG. 24 is a side view of an exhaust gas nozzle similar to that shown in FIGS. 20 and 21 but fitted with an optional cowl or peripheral skirt.
Figure 25:
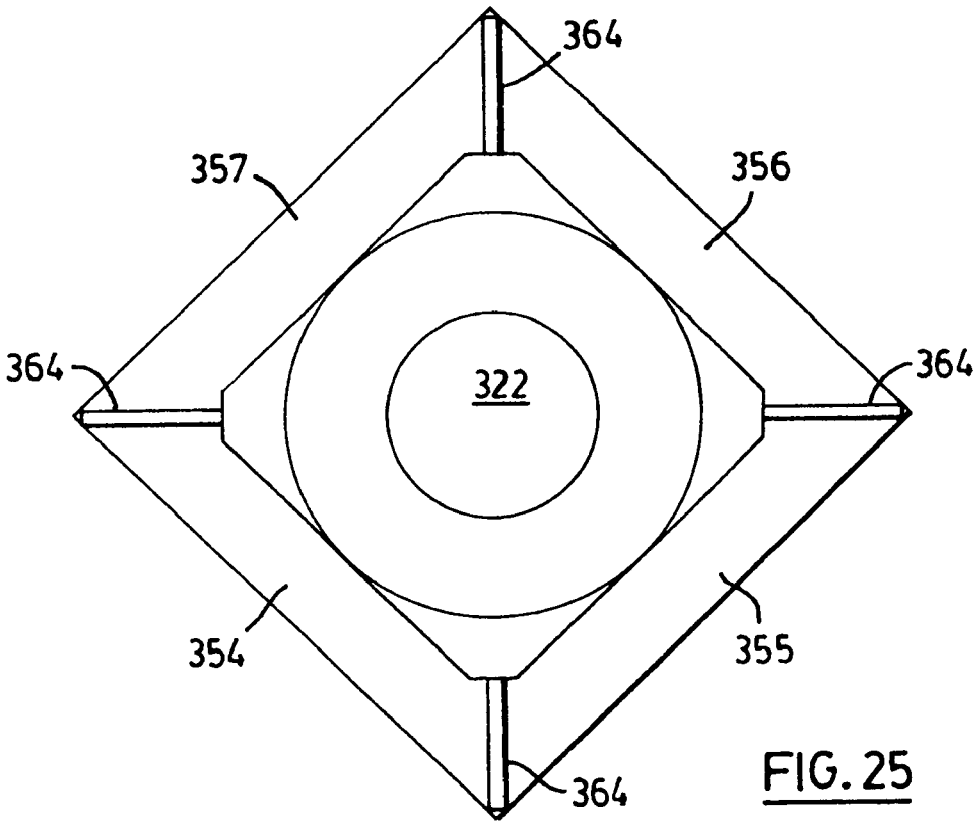
FIG. 25 is a bottom view of the exhaust gas nozzle of FIG. 24.

FIGS. 24 and 25 illustrate a couple of optional additional features that can be included in an exhaust gas discharging apparatus 310 of the type illustrated in FIGS. 20 to 23. Firstly, an extension 352 in the form of a short cylindrical member can be added to the top of the annular cap 314 to provide more enclosed area for the mixing of the fresh incoming air with the exhaust gases. Secondly, there can be attached to or formed at the bottom end of the cap interconnected wall sections 354 to 357 which form a minor bottom portion of the cap. These four wall sections slope upwardly and inwardly from the cap inlet located at 360. As illustrated, the amount of the slope is less than 45 degrees to horizontal and preferably is in the order of about 30 degrees to the horizontal. Thus, the slope of these wall sections is less than that of the major upper portion 362 of the cap. It will be appreciated that these interconnected wall sections form a type of cowl or windband to help capture and direct the surrounding air into the cap. Also, if desired, the vertically extending wind deflecting members of this exhaust gas discharging apparatus 310 can include extensions 364 located at the four corners formed by the wall sections 354 to 357. Although the illustrated extensions 364, shown in solid lines, are triangular, it is of course possible for these extensions to have other shapes, including trapezoidal with a horizontal bottom edge indicated by dash line 390. The extensions 364 are preferably connected at their top edges to the wall section 354 to 357 where they meet at the corners. Thus, the extensions can help support and add rigidity to the sloping wall sections. If each extension 364 has a trapezoidal shape, its radial outer edge can extend vertically down from the adjacent corner of the wall sections 354 to 357 as indicated by dash line 392.

It is also possible to employ a known type of commercial sound insulating material on the cap and/or wind bands and on the duct member of the gas nozzle, if desired, in order to reduce the amount of sound generated from the apparatus. The use of layer of sound insulating material is shown and described in U.S. Pat. No. 6,112,850 which issued Sep. 5, 2000 to Met Pro Corporation and the description and drawings of this patent specification are incorporated herein by reference. The sound insulating material can comprise stainless steel wool or fiberglass material which is covered at least in part with perforated sheet material such as perforated steel, fiberglass or polypropylene.

Finally, it will be understood that various changes in size and shape of the parts and components of these exhaust gas nozzle arrangements can be made beyond what has been illustrated and described. For example, the nozzle member and vertically extending, wind deflecting panels, can also be used in conjunction with a mixed flow inline fan. It is to be understood that the various described duct members can readily be constructed as a unitary part, or of several parts joined together by conventional means such as bolting or rivets. Additionally, it should be appreciated that the nozzle member, including the wind band, can be constructed out of a wide variety of materials, including fiberglass, galvanized steel, stainless steel and epoxy-coated steel. These various modifications and others which may be obvious to persons of ordinary skill in the art may be made without departing from the spirit and scope of the present invention, which is limited only by the claims appended hereto, purposively construed.

I claim:

1. An exhaust gas discharging apparatus for attachment to an outlet of an exhaust fan, said apparatus comprising:

an exhaust gas nozzle including duct means for forming at least one exhaust passage, that extends from an open first end connectible to said outlet of the exhaust fan to an open second end of the duct means, and having a centrally disposed longitudinal axis extending between said first and second ends, said duct means being provided by at least one duct wall forming at least two longitudinally extending bent wall portions that are distributed evenly about the periphery of the duct means, each bent wall portion sloping inwardly towards said longitudinal axis and in the direction of said second end;

said at least one exhaust passage defining an area measured in horizontal cross-section, and wherein said area does not decrease from said first end to said second end of said duct means:

said gas nozzle further including an annular cap connected to said duct means and disposed about the exterior of and in spaced, substantially co-axial relation to said second end of the duct means, said cap having a cap inlet located between said first end and said second end of said duct means and outside said duct means and a cap outlet located outwardly from said second end in the direction of said longitudinal axis; and vertically extending wind deflecting members mounted on said duct means and extending horizontally outwardly from said at least one duct wall, said wind deflecting members extending vertically below said annular cap.

2. An exhaust gas discharging apparatus according to claim 1 wherein said wind deflecting members are flat panels that extend in vertical planes and that are distributed substantially evenly and circumferentially about said duct means.

3. An exhaust gas discharging apparatus according to claim 1 wherein said wind deflecting members extend into said annular cap and connect said cap to said at least one exterior duct wall.

4. An exhaust gas discharging apparatus according to claim 1 wherein there are two of said bent wall portions, two longitudinally extending opposing sidewall portions connecting together said bent wall portions, and four of said wind deflecting members with a respective pair of said members extending outwardly from each sidewall portion.

5. An exhaust gas discharging apparatus according to claim 1 including at least one annular wind band extending around the exterior of said duct means below said annular cap and comprising an annular wall that slopes upwardly and inwardly around its circumference, the or each wind band forming an annular air inlet at its bottom end and an annular air outlet at its top end.

6. An exhaust gas discharging apparatus according to claim 1 wherein said annular cap has a major upper portion with a frusto-conical shape that tapers in an upwards direction and a minor bottom portion comprising an annular wall section that tapers upwardly and inwardly from said cap inlet, the taper of said annular wall section being greater than that of said major upper portion.

7. An exhaust gas discharging apparatus according to claim 1 including—guide vanes extending between and connected to said wind deflecting members, each of said guide vanes sloping upwardly and inwardly towards said longitudinal axis.

8. A fan apparatus comprising:

a fan housing having a fan inlet adapted to receive gas or air to be exhausted and a fan outlet to expel the gas or air from the housing, a fan rotatably mounted within said fan housing and adapted to draw the gas or air in through said fan inlet and to expel the gas or air through said fan outlet; and an exhaust gas discharging apparatus according to claim 1 connected to said fan housing at said fan outlet, wherein said duct means is connected to said fan outlet at said open first end.

9. An exhaust gas discharging apparatus according to claim 1 wherein the second end of the duct means has four flared portions and said annular cap has a round top end and includes interconnected wall sections that slope upwardly and inwardly from said cap inlet.

10. An exhaust gas discharging apparatus for attachment to an outlet of an exhaust fan, said apparatus comprising:

a duct member forming a single exhaust passage that extends from an open first end connectible to said outlet of the exhaust fan to an open second end of said duct member, a centrally disposed longitudinal axis extending between said first and second ends, said duct member being formed by a duct wall having at least two longitudinally extending bent wall portions that are distributed substantially evenly about the periphery of the duct member which extends about said longitudinal axis, each bent wall portion projecting inwardly towards said longitudinal axis as seen in transverse planes in the region of said second end whereby said bent wall portions gradually and increasingly pinch said single passage in the direction of said second end;

said single exhaust passage defining an area measured in horizontal cross-section, and wherein said area does not decrease from said first end to said second end of said duct means;

an annular cap connected to said duct member and disposed about the exterior of and in spaced, substantially coaxial relation to said second end of the duct member, said cap having a cap inlet located between said first end and said second end of the duct member and outside said duct member and a cap outlet located outwardly from said second end in the direction of said longitudinal axis; and vertically extending, wind deflecting members on said duct member extending horizontally outwardly from said duct wall, said wind deflecting members extending vertically below said annular cap.

11. An exhaust gas discharging apparatus according to claim 10 wherein said wind deflecting members are flat panels that extend in vertical planes and that are distributed substantially evenly and circumferentially about said duct member.

12. An exhaust gas discharging apparatus according to claim 10 including wind bands extending around the exterior of said duct wall below said annular cap, each wind band comprising an annular wall that slopes upwardly and inwardly from an annular wind band inlet to an annular wind band outlet around its circumference.

* * * * *